United States Patent [19]

Ross

[11] 4,059,968

[45] Nov. 29, 1977

[54] REFRIGERATION SYSTEM

[75] Inventor: Robert R. Ross, Wheaton, Ill.

[73] Assignee: H. A. Phillips & Co., St. Charles, Ill.

[21] Appl. No.: 673,601

[22] Filed: Apr. 5, 1976

Related U.S. Application Data

[63] Continuation-in-part of Ser. No. 484,271, June 28, 1974, abandoned.

[51] Int. Cl.[2] ..... F25B 41/00

[52] U.S. Cl. ..... 62/174; 62/197; 62/510

[58] Field of Search ..... 62/510, 509, 174, 197

[56] References Cited

U.S. PATENT DOCUMENTS

| | | | |
|---|---|---|---|
| 2,655,008 | 10/1953 | Sloan et al. | 62/174 X |
| 2,871,673 | 2/1959 | Richards et al. | 62/509 X |
| 2,966,043 | 12/1960 | Ross | 62/174 |
| 3,568,466 | 3/1971 | Brandin et al. | 62/510 |

*Primary Examiner*—William E. Wayner
*Attorney, Agent, or Firm*—Richard G. Lione

[57] ABSTRACT

A recirculating refrigeration system wherein a screw compressor receives vaporized refrigerant from the evaporators at its low pressure inlet and from a flash tank or receiver at an intermediate pressure inlet. Refrigerant which is not vaporized in the evaporators is trapped in a suction line accumulator from which it flows by gravity into a dump tank. The dump tank has a gas pressure connection to the compressor outlet or to the receiver or flash tank and a control valve is effective to introduce gas under pressure to the dump tank and force the liquid accumulated therein back into a receiver when it has risen to a predetermined level in the dump tank.

2 Claims, 2 Drawing Figures

REFRIGERATION SYSTEM

PRIOR APPLICATION

This application is a continuation-in-part of application Ser. No. 484,271, filed June 28, 1974 and entitled REFRIGERATION SYSTEM, now abandoned.

FIELD OF THE INVENTION

This invention is in the field of refrigeration. It relates more particularly to refrigeration systems of the large, industrial type.

BACKGROUND OF THE INVENTION

H. A. Phillips & Co. of Chicago, Ill., assignee of this application, has long been a leader in the design, development and installation of industrial type refrigeration systems. A pioneer in recirculating systems, its engineers have constantly sought new and improved refrigeration systems and equipment. Systems and components for refrigeration which have been developed at Phillips include Phillips Pat. No. 2,570,979; Phillips Pat. No. 2,589,859; Phillips Pat. No. 2,641,281; Richards Pat. No. 2,841,962; Richards et al Pat. No. 2,871,673; Ross Pat. No. 2,966,043; and Ross Pat. No. 3,315,484. Of course, research and development continues toward more efficient yet less expensive systems.

SUMMARY OF THE INVENTION

It is an object of this invention to provide an improved recirculating refrigeration system which is extremely efficient, using a minimum amount of energy to achieve a high level of refrigeration. It is another object to provide a recirculating refrigeration system employing a new and improved compressor arrangement in the system. It is another object to provide a refrigeration system incorporating a screw-type compressor in a dump recirculation circuit.

The foregoing and other objects are realized by providing a refrigeration system wherein a screw-type compressor is utilized for compressing vaporized refrigerant to an output pressure of approximately one hundred fifty (150) psi in the exemplary system described. A condensor receives the compressed refrigerant gas from the compressor and liquifies it, directing the liquified refrigerant to a receiver or "flash" tank at lower pressure. The refrigeration system evaporators receive liquified refrigerant from the receiver tank and, in the process of refrigeration, a substantial portion of the refrigerant is vaporized. This vaporized refrigerant is returned to the low pressure inlet of the screw-type compressor. Meanwhile, "flash" gas or vaporized refrigerant is formed in the receiver tank due to a drop in pressure. This gas in the receiver tank is at a substantially higher pressure than vaporized refrigerant which leaves the evaporator, albeit a lower pressure than the compressor output.

In one embodiment of the invention, all of this receiver tank gas is returned to an intermediate inlet of the screw-type compressor, known as the "economizer" section in the trade, at the intermediate pressure. The compressor is effective to compress this higher pressure inlet gas to its normal output pressure while passing it through only a segment of the compressor, thus requiring less energy to achieve a higher overall pressurized refrigerant gas output. In another embodiment of the invention incorporating two receivers or "flash" tanks, a portion of this first receiver tank gas is bled off to be used, according to the invention, in a manner hereinafter described to dump accumulated liquid in a dump tank back into the second of these receivers. The use of the flash gas to accomplish liquid transfer decreases power consumption In either embodiment, unvaporized refrigerant which reaches the accumulator tank flows from it by gravity through a check valve into a dump tank. Whenever the liquid level in the dump tank reaches a prescribed level, high pressure outlet gas is introduced to the dump tank forcing its liquid refrigerant contents into the receiver. The dump tank liquid is inherently well below vaporization temperature so that when it is returned to the receiver it super-cools the receiver liquid. As a result, flash gas does not form in passage to the evaporator even if the evaporator is above the receiver and thus at a lower pressure.

BRIEF DESCRIPTION OF THE DRAWING

The system embodying features of the invention, including its method of operation, together with other additional objects and advantages thereof, is illustrated schematically in the following drawings, in which.

DESCRIPTION OF THE PREFERRED EMBODIMENTS

Figure 1:
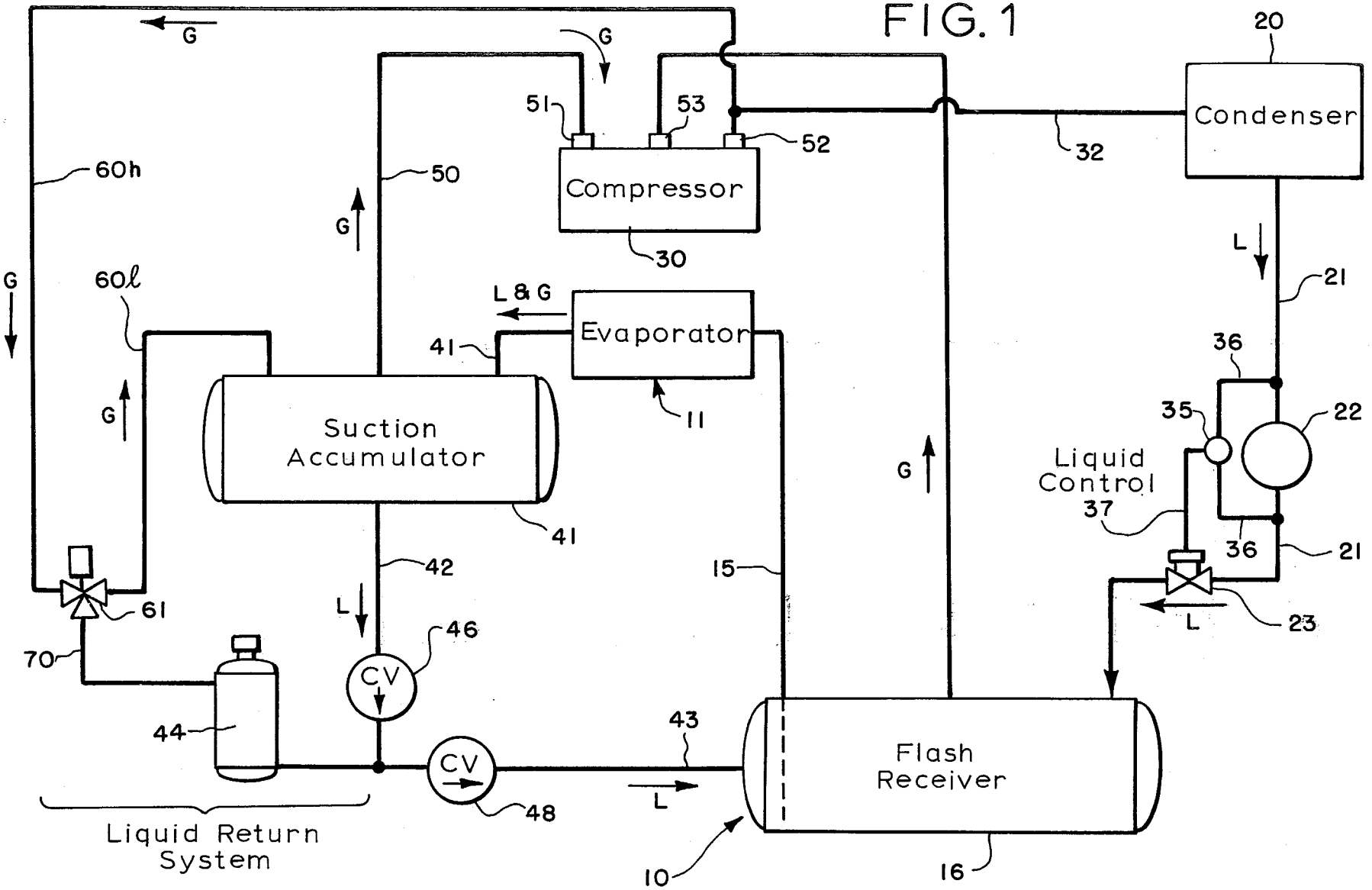
FIG. 1 is a schematic illustration of one form of system.

Referring now to the drawing, a refrigeration system embodying features of one form of the present invention is illustrated schematically at 10. The system 10 is designed to provide highly efficient refrigeration in an industrial plant, for example, through the medium of an evaporator unit or units 11 which receives liquid ammonia refrigerant. In this light, the system 10 is adapted for the use of liquid ammonia refrigerant, but other refrigerants might also be used in systems embodying features of the present invention, including halogen compounds or methanes, for example.

The evaporator 11 receives refrigerant liquid through line 15 from a flash receiver tank 16. The receiver tank 16 receives liquid refrigerant from a condensor 20 through a line 21 in which a pilot receiver tank 22 and control valve 23 are interposed.

The condensor 20 has received ammonia gas under a pressure of approximately one hundred fifty (150) psi from the system's compressor 30 through a high pressure gas line 32. The condensor 20, which in itself is conventional in construction, liquifies the hot gas by removing a substantial portion of its heat while the gas is under pressure. Liquified ammonia leaves the condensor 20 through the line 21.

The flow of refrigerant liquid to the flash receiver 16 is regulated by the valve 23. The valve 23 is, in turn, controlled by a liquid level sensing float valve 35 having pressure equalization lines 36 communicating with the line 21 above and below the pilot receiver 22. The float valve 35 is connected to and operates the control valve 23 through a control line 37.

As the liquid level rises in the pilot receiver 22, it also rises in the float valve 35. When it rises to a predetermined level, the float valve 35 is effective to open the control valve 23, permitting liquid flow to the flash receiver 16. A pressure drop occurs across the valve 23. As a result, the pressure in the flash receiver 16 is approximately twenty-five to fifty (25–50) psi.

Liquid refrigerant from the flash receiver 16 is forced through the evaporator 11 where it performs its refrigerating function, as has been pointed out, in an industrial freezer, for example. A combination of liquid and gas depart the evaporator 11 through the return line 40 to a suction accumulator 41. The accumulator 41 returns the liquid refrigerant to the flash receiver 16 in a manner hereinafter discussed through a return line 42 teed into return-feed line 43 connecting a dump tank 44 with the receiver. Check valve 46 prevents back flow in the line 42 while check valve 48 performs the same function in the line 43.

Vaporized refrigerant; i.e., gas, in the accumulator 41, flows through return line 50 to the compressor 30, drawn by suction from the compressor inlet end 51. The compressor 30 is a conventional screw compressor which receives this gas at a pressure of approximately twenty (20) psi. The compressor 30 discharges gas from its outlet end 52 at a pressure of approximately one hundred fifty (150) psi, as has been pointed out, into the high pressure line 32.

At the same time, flash gas which forms in the receiver 16 is being bled back to the screw compressor 30 through return line 33 to an intermediate inlet 53 on the compressor. This gas, normally at a pressure of from twenty-five to fifty (25–50) psi when introduced to the compressor 30 (higher than the gas pressure at inlet 51) is compressed from this intermediate pressure to the output pressure of approximately one hundred fifty (150) psi through only the second or "economizer" section of the compressor.

Tapped into the high pressure output line 32 is a high pressure branch line 60H. The line 60H is connected to a three-way dump valve 61 which is, in turn, connected through a lower pressure branch line 60L back to the suction accumulator 41. The valve 61 is effective, in normal operation of the system, to block line 60H and place accumulator 41 and dump tank 44 in communication through line 60L and line 70. Normally, then pressure in accumulator 41 and dump tank 44 is equalized so that liquid refrigerant arriving in the accumulator 41 flows by gravity through the lines 42 and 43 into the dump tank 44.

When the liquid level in the dump tank 44 rises to a predetermined point, the port in the dump valve 61 which is connected to the line 70 opens so that high pressure gas flows from line 60H through the line 70 into the dump tank 44. Pressure build-up in the dump tank 44 forces liquid refrigerant from the tank 44 through the line 43 and past the check valve 48 into the flash receiver 16.

When the dump tank 44 has been emptied as indicated by a sensor, or after a predetermined time delay period calculated to empty the tank, the high pressure outlet port of the three-way dump valve 61 closes and the low pressure outlet port to the line 60L opens. Pressure in the dump tank 44 and the suction accumulator 41 is equalized. Dumping stops and liquid refrigerant again is permitted to flow by the force of gravity through the line 42 from the accumulator 41 into the dump tank 44.

Figure 2:
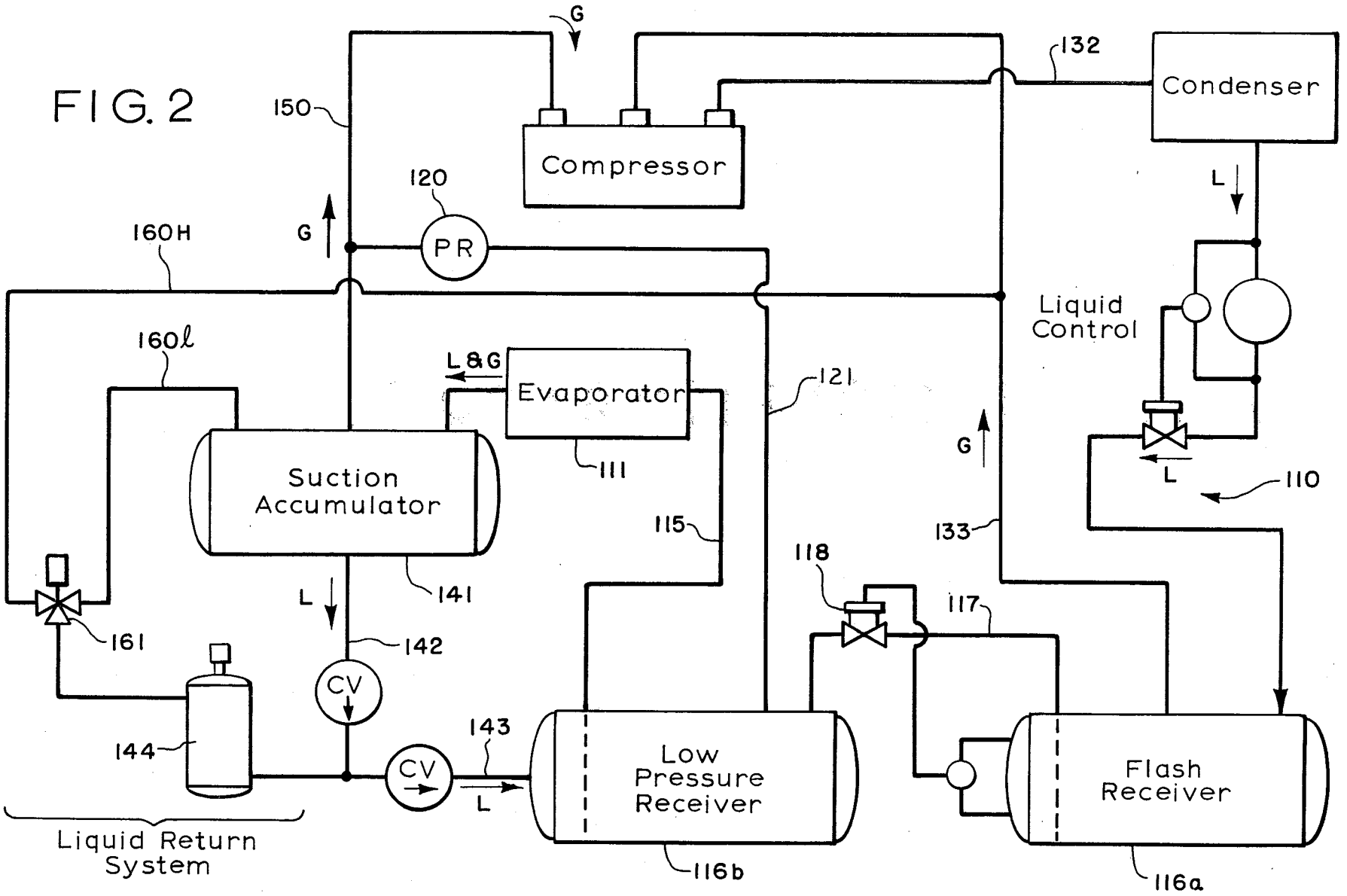
FIG. 2 is a schematic illustration of another form of the system.

The system 10 has been described in terms of a single receiver 16. However, the invention is equally applicable to a multiple receiver system and, if circumstances dictate, a system employing a high pressure receiver and a low pressure receiver, for example, is utilized. FIG. 2 illustrates such a system at 110.

The system 110 is identical to the system 10 hereinbefore discussed in many respects. Accordingly, corresponding components are identified by corresponding reference numerals plus one hundred (100) digits. In essence, the system 110 is distinguished from the system 10 in that it employs a flash receiver 116A and a low pressure receiver 116B through a connecting line 117. A control valve 118 in line 117 controls the flow of liquid from the receiver 116A to the receiver 116B by opening in response to a liquid level rise in the receiver 116A (in much the same manner as the liquid control described previously at page 4, line 18, with regard to the pilot receiver 22). Alternatively, if the sensing means were on the low pressure receiver 116B, a drop in the liquid level in the receiver 116B would cause the liquid control valve 118 to open.

Gas refrigerant pressure in the flash receiver 116A is normally approximately fifty (50) psi while a reduced pressure of approximately thirty (30) psi is normal in the low pressure receiver 116B. Pressure in the latter is controlled by means of a pressure regulator valve 120 in line 121. The evaporator 111 is fed liquid refrigerant through the line 115 from the receiver 116B.

The operation of the dump valve 161, dump tank 144 and suction accumulator 141 is substantially identical to that described in relation to the system 10. However, the gas utilized to pressurize the dump tank 144 when liquid rising therein reaches a predetermined level is drawn through the line 160H tapped into the line 133 from the high pressure receiver 116A to the intermediate inlet 153 of the compressor 130. Flash gas from the high pressure receiver 116A is thus used to dump the tank 144 at power savings exceeding sixty percent (60%).

The systems 10 and 110 provide highly efficient and effective refrigeration for a large requirement industrial installation. The flash receiver connected to the economy port of the screw compressor 30 has sufficient pressure therein for feeding liquid directly to the evaporators, or to the low pressure receiver 110, thus eliminating the need for mechanical liquid circulating pumps. These receiver tanks are also utilized for receiving excess liquid returning from the evaporators via the liquid transfer system.

The screw compressor compresses vaporized refrigerant received from the evaporator and also flash gas bled from a receiver tank. As has been pointed out, pressure gas periodically forces liquid accumulated in the dump tank back into a receiving tank. Optimum energy utilization is achieved, the desirability of which requires no explanation in this day and age.

Both systems are extremely simple. They are relatively inexpensive to install and maintain. In effect, very high performance at relatively low cost is achieved.

While several embodiments described herein are at present considered to be preferred, it is understood that various modifications and improvements may be made therein, and it is intended to cover in the appended claims all such modification and improvements as fall within the true spirit and scope of the invention.

What is desired to be claimed and secured by Letters Patent of the United States is:

1. A circulating refrigeration system, comprising:

a. compressor means for compressing vaporized refrigerant, b. condensor means for receiving compressed refrigerant gas from said compressor means and removing heat from said gas to liquify all or a substantial portion of it, c. a receiver tank for receiving said liquified refrigerant from said condensor means and having a predetermined relatively high gas pressure therein, d. evaporator means, e. a receiver tank for receiving refrigerant liquid from said high pressure receiver tank and having a predetermined lower gas pressure therein, f. liquified refrigerant from said low pressure receiver tank being forced from said low pressure receiver tank through said evaporator means in an amount substantially exceeding the evaporator means requirement for achieving the system's designed refrigeration output and refrigerant vaporized in said evaporator means being returned to said compressor means for compression, g. said compressor means being a screw compressor having a low pressure inlet to a first stage, an intermediate pressure inlet to a second stage, and a high pressure outlet, h. said vaporized refrigerant from said evaporator means being returned to said low pressure inlet, i. at least a portion of the vaporized refrigerant which reaches said high pressure receiver tank being bled to said compressor through said intermediate pressure inlet, j. means for accumulating unvaporized liquid refrigerant from said evaporator, k. said unvaporized liquid refrigerant being substantially cooler than the saturated liquid in said low pressure receiver tank as a result of the evaporation of refrigerant, l. dump tank means for receiving liquid refrigerant from said accumulating means, and m. means connecting said high pressure receiver tank with said dump tank means through a control valve, n. said control valve being effective upon receipt of a predetermined signal to direct flash gas under pressure from said high pressure into said dump tank means to force liquid refrigerant therein back to said low pressure receiver tank.

2.

a. compressor means for compressing vaporized refrigerant, b. condensor means for receiving compressed refrigerant gas from said compressor means and removing heat from said gas to liquify all or a substantial portion of it, c. receiver tank means for receiving said liquified refrigerant from said condensor means, d. evaporator means, e. liquified refrigerant from said receiver tank means being forced from said receiver tank means through said evaporator means in an amount substantially exceeding the evaporator means requirement for achieving the system's designed refrigeration output, f. refrigerant vaporized in said evaporator means being returned to said compressor means for compression, g. said compressor means being a screw compressor having a low pressure inlet to a first stage, an intermediate pressure inlet to a second stage, and a high pressure outlet, h. said vaporized refrigerant from said evaporator means being returned to said low pressure inlet, i. said receiver tank means being in open, unrestricted communication with said intermediate pressure inlet to said screw compressor whereby at least a portion of the vaporized refrigerant which reaches said receiver tank means flows uncontrolled to said compressor through said intermediate pressure inlet, j. means for accumulating unvaporized liquid refrigerant from said evaporator, k. said unvaporized liquid refrigerant being substantially cooler than the saturated liquid in said receiver tank means as a result of the evaporation of refrigerant, and l. dump tank means into which liquid refrigerant from said evaporator means flows, m. said dump tank means being connected to the high pressure outlet of said compressor through a control valve, n. said control valve being effective upon receipt of a predetermined signal to direct gas under pressure into said dump tank to force liquid refrigerant therein back to said receiver tank means.

* * * * *

UNITED STATES PATENT AND TRADEMARK OFFICE

CERTIFICATE OF CORRECTION

PATENT NO. : 4,059,968

DATED : November 29, 1977

INVENTOR(S) : Robert R. Ross

It is certified that error appears in the above-identified patent and that said Letters Patent are hereby corrected as shown below:

Column 5, line 43, "2." Please add the following sentence to read as follows:

-- 2. A refrigeration system, comprising: --

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*